US006559752B1

(12) United States Patent
Sienkiewicz et al.

(10) Patent No.: US 6,559,752 B1
(45) Date of Patent: May 6, 2003

(54) CREEPLESS SNAP ACTING BIMETALLIC SWITCH HAVING FLEXIBLE CONTACT MEMBERS

(76) Inventors: Frank J. Sienkiewicz, 1 Peck Rock Rd., Bristol, RI (US) 02809; Christopher Cornell, 463 Rock O'Dundee Rd., South Darthmouth, MA (US) 02748

( * ) Notice: Subject to any disclaimer, the term of this patent is extended or adjusted under 35 U.S.C. 154(b) by 0 days.

(21) Appl. No.: 09/578,053

(22) Filed: May 24, 2000

Related U.S. Application Data

(60) Provisional application No. 60/135,531, filed on May 24, 1999, and provisional application No. 60/143,008, filed on Jul. 9, 1999.

(51) Int. Cl.[7] ..... H01H 71/16; H01H 61/02

(52) U.S. Cl. ..... 337/53; 337/36; 337/343

(58) Field of Search ..... 337/36, 53, 342, 337/343, 298, 333, 347, 348, 349, 354, 368; 29/623

(56) References Cited

U.S. PATENT DOCUMENTS

| | | | | |
|---|---|---|---|---|
| 2,340,056 A | | 1/1944 | Harrison | |
| 2,724,753 A | | 11/1955 | Miles | |
| 3,067,306 A | | 12/1962 | Epstein | |
| 3,577,111 A | * | 5/1971 | Nardulli | 337/89 |
| 3,660,793 A | | 5/1972 | Them et al. | |
| 4,101,861 A | * | 7/1978 | Jenne | 337/368 |
| 4,220,939 A | * | 9/1980 | Grable | 337/94 |
| 4,260,862 A | * | 4/1981 | Orcutt | 200/81 R |
| 4,278,960 A | | 7/1981 | Muller | |
| 4,318,071 A | * | 3/1982 | Shepherd | 337/136 |
| 4,319,214 A | | 3/1982 | Givler | |
| 4,424,506 A | | 1/1984 | Burch | |
| 4,445,105 A | * | 4/1984 | Wehl | 337/94 |

(List continued on next page.)

FOREIGN PATENT DOCUMENTS

| | | | | |
|---|---|---|---|---|
| DE | 1 590 611 | | 5/1966 | |
| FR | 1 296 066 | | 5/1961 | |
| GB | 2281445 A | * | 3/1995 | H01H/37/52 |
| JP | 62-130310 | | 5/1987 | |

*Primary Examiner*—Anatoly Vortman
(74) *Attorney, Agent, or Firm*—Kris T. Fredrick

(57) ABSTRACT

A creepless snap acting bimetallic switch having flexible contact members. The bimetallic switch comprises: a bimetallic element being adapted to snap between a first mode and a second mode, the first mode corresponding to a closed position of the switch, and the second mode corresponding to an open position of the switch; a first flexible contact member disposed adjacent the bimetallic element and having a first contact portion thereon; a first terminal electrically conductively coupled to the first flexible contact member; a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween; a second terminal electrically conductively coupled to the second contact portion such that when the switch is closed, electrical continuity exists between the first terminal and the second terminal; wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode. Advantageously, the bimetallic element may be configured as a bimetallic disc. An alternate embodiment of the switch latches into an open configuration.

23 Claims, 5 Drawing Sheets

U.S. PATENT DOCUMENTS 4,517,541 A 5/1985 Ubukata et al.
4,563,667 A * 1/1986 Hofsass ..... 337/349
4,862,133 A 8/1989 Tabei
5,121,095 A 6/1992 Ubukata et al.
5,309,131 A 5/1994 Hofass et al.
5,428,336 A 6/1995 Smith et al.
5,574,421 A 11/1996 Hickling
5,659,285 A 8/1997 Takeda
5,685,481 A 11/1997 Murphy et al.
5,696,479 A * 12/1997 Oughton et al. ..... 337/333
5,870,013 A * 2/1999 Van Der Grijn et al. ... 337/343
6,281,780 B1 * 8/2001 Sugiyama et al. ..... 337/137

* cited by examiner

CREEPLESS SNAP ACTING BIMETALLIC SWITCH HAVING FLEXIBLE CONTACT MEMBERS

This application claims the benefit of U.S. Provisional Application No. 60/135,531 filed on May 24, 1999 and U.S. Provisional Application No. 60/143,008 filed on Jul. 9, 1999.

FIELD OF THE INVENTION

The invention relates to a bimetallic switch having a bimetallic element adapted to snap between a first mode and a second mode.

BACKGROUND OF THE INVENTION

Temperature controlled bimetallic switches are well known in the art. The bimetal supplies the force to open or close the contact system of the switch. These switches are used to prevent overheating or overcurrent conditions in a great number of electrical appliances, both large and small, such as household appliances, automobile components, and office automation equipment.

Various shapes of bimetallic elements are available, such as discs or cantilever strips. The thermal deflection of a strip element is usually easier to predict because formulas to predict deflection due to temperature are readily available. On the other hand, bimetallic discs are also useful. These tend to change from a concave shape to a convex shape in response to changes in temperature.

There are three classifications to the type of bimetallic switches available in the art. These are: automatic reset, manual reset and one shot. Automatic resets have two distinct temperature points. A normally closed switch will open when exposed to heat at the higher of the two temperature points. When the switch cools, it will then automatically close at the lower temperature threshold. Manual reset switches, on the other hand, are typically closed, and have only an open threshold temperature. They require an outside force (such as, for example, a push button), to reset the bimetal disc after it has been opened. One shots will snap open only once and will not reset under normal conditions. They are actually automatic devices, except that the disc has been formed to have a low temperature point of −100° Celsius. While one shots and manuals are typically used to protect a process, automatics are used on the other hand to control a process. There is, in addition, a hybrid version of an automatic switch, which is called a power down reset. The device includes a heat source which is activated when the contact portions are opened because of increased temperature. This heat source produces enough heat to keep the bimetal above the low reset temperature threshold. In order for the device to reset, power to the switch must be removed and the temperature be low enough for the device to reset.

Bimetallic discs are said to "snap" when they change state from a concave shape to a convex shape when exposed to increased temperature. The time that the disc takes to snap is related, among other things, to the temperature change that it is exposed to.

One problem associated with the use of bimetallic switches is creep. The snapping over of the disc does not occur evenly across the snap time. There is in fact a transition state where the disc moves very slowly when compared to the total action time. This slow rate of movement is called "creep". Thus, when a formed snap acting bimetallic element gets close to its snap temperature (i.e. the threshold temperature at which the bimetallic element snaps in order to open or close the switch), it begins to deflect slightly. Depending on how the contact system is arranged, this small deflection or creep may lead to a contact gap prior to a snapping over of the bimetallic element. It is to be noted that the size of the arc is additionally related to electrical load and voltage as well as to other environmental factors. As a result, some thermostats may not arc because of the loads they switch.

Among examples of bimetallic switches of the prior art which may exhibit the problem of creep are those described in U.S. Pat. Nos. 4,862,133, 4,517,541, 4,424,506, 3,577,111, 3,067,306, 2,724,753 and 2,340,056.

Various designs for bimetallic switches have been proposed to resolve the problem of creep.

Japanese Patent Number 63-292539 discloses a bimetallic switch designed to prevent malfunction and vibrations during normal service. Here, as seen in the figures of that patent, the bimetallic disc 4 is supported by support pieces 7 having supporting surfaces 6, which are formed alongside the locus of the ends 8 of disc 4 under the service temperature thereof. Even though the disc deforms within the temperature range of its service temperature, the convex side of the central part 5 of bimetal 4 does not push the base 1 or movable contact piece 3, or separate therefrom, to a great extent. In this way, malfunction due to creep, and vibrations, may be prevented.

U.S. Pat. No. 5,121,095 uses an elaborate spring member independent of the contact arms to remove creep. The switch contacts are actuated via the bimetal to a spring member, to an insulated pin, and to a contact arm system.

Other current designs remove creep through an expensive measurement and custom part assembly process which involves the installation of a pin measured to very mall tolerances, such as 0.001", in each thermostat assembly. In such a case, a manufacturer must stock numerous pins to allow for the tolerance stack of the final assembly.

The above devices, which address the problem of creep, nevertheless do so at the. cost of having to provide complicated and difficult to manufacture designs for bimetallic switches. Attention must be paid to the costs of manufacture including both labor and material costs.

It is therefore an object of the invention to provide a simple and cost effective bimetallic switch which allows for a creepless contact system. It is a further object to provide a bimetallic switch having a small footprint and employing a disc which is smaller relative to discs of the prior art.

SUMMARY OF THE INVENTION

The above object, and others to become apparent as the description progresses, is achieved by the provision of a bimetallic switch comprising: a bimetallic element being adapted to snap between a first mode and a second mode, the first mode corresponding to a closed position of the switch, and the second mode corresponding to an open position of the switch; a first flexible contact member disposed adjacent the bimetallic element and having a first contact portion thereon; a first terminal electrically conductively coupled to the first flexible contact member; a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween; a second terminal electrically conductively coupled to the second contact portion such that when the switch is closed, electrical continuity exists between the first terminal and the second terminal; wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode. Advantageously, the bimetallic element may be configured as a bimetallic disc.

According to one embodiment, the bimetallic switch comprises a housing having inner walls defining a partial enclosure therein, wherein the bimetallic element, the first flexible contact member and the second flexible contact member are disposed within the partial enclosure. Advantageously, the inner walls of the housing may define a recess therein as part of the partial enclosure, the bimetallic element being accommodated in the recess. Additionally, where the bimetallic element is a bimetallic disc, the recess may be configured to be cylindrical and to have a seat accommodating an outer edge of the disc therein. A cover may further be disposed over the partial enclosure to close the same for defining an enclosure about the bimetallic element, the first flexible contact member and the second flexible contact member. Additionally, a gapped or open cover may be used in conjunction with a thin wafer or film disposed between the cover and the partial enclosure for enhancing a thermal response of the switch. Optionally, the housing is one of parallelepiped-shaped, round and oval.

According to one embodiment of the invention, the first flexible contact member comprises a first cantilever arm; and the second flexible contact member comprises a second cantilever arm, the first contact portion and the second contact portion being disposed on respective free ends of the first cantilever arm and the second cantilever arm. The second contact portion may comprise a flange extending toward the first contact portion.

According to another embodiment, the first contact portion is positioned with respect to the second contact portion for maintaining a minimum open contact gap therebetween thereby isolating creep during contact closure.

DETAILED DESCRIPTION OF THE INVENTION

Figure 1:
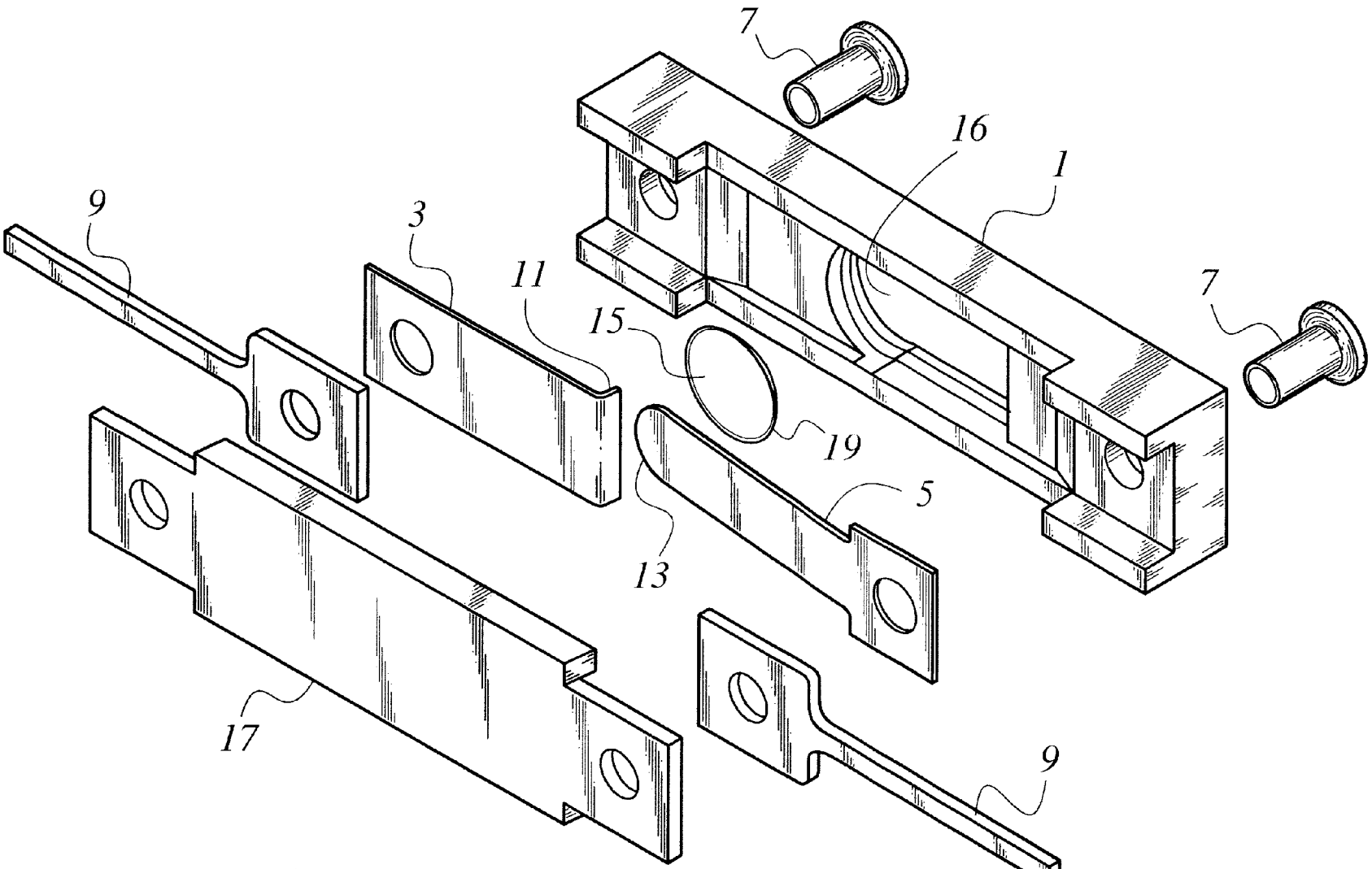
FIG. 1 is an exploded, perspective top view of an embodiment of a bimetallic switch according to the invention.

For clarity of exposition, like features shown in the accompanying drawings shall be indicated with like reference numerals and similar features as shown in alternate embodiments in the drawings shall be indicated with similar reference numerals.

Figure 2:
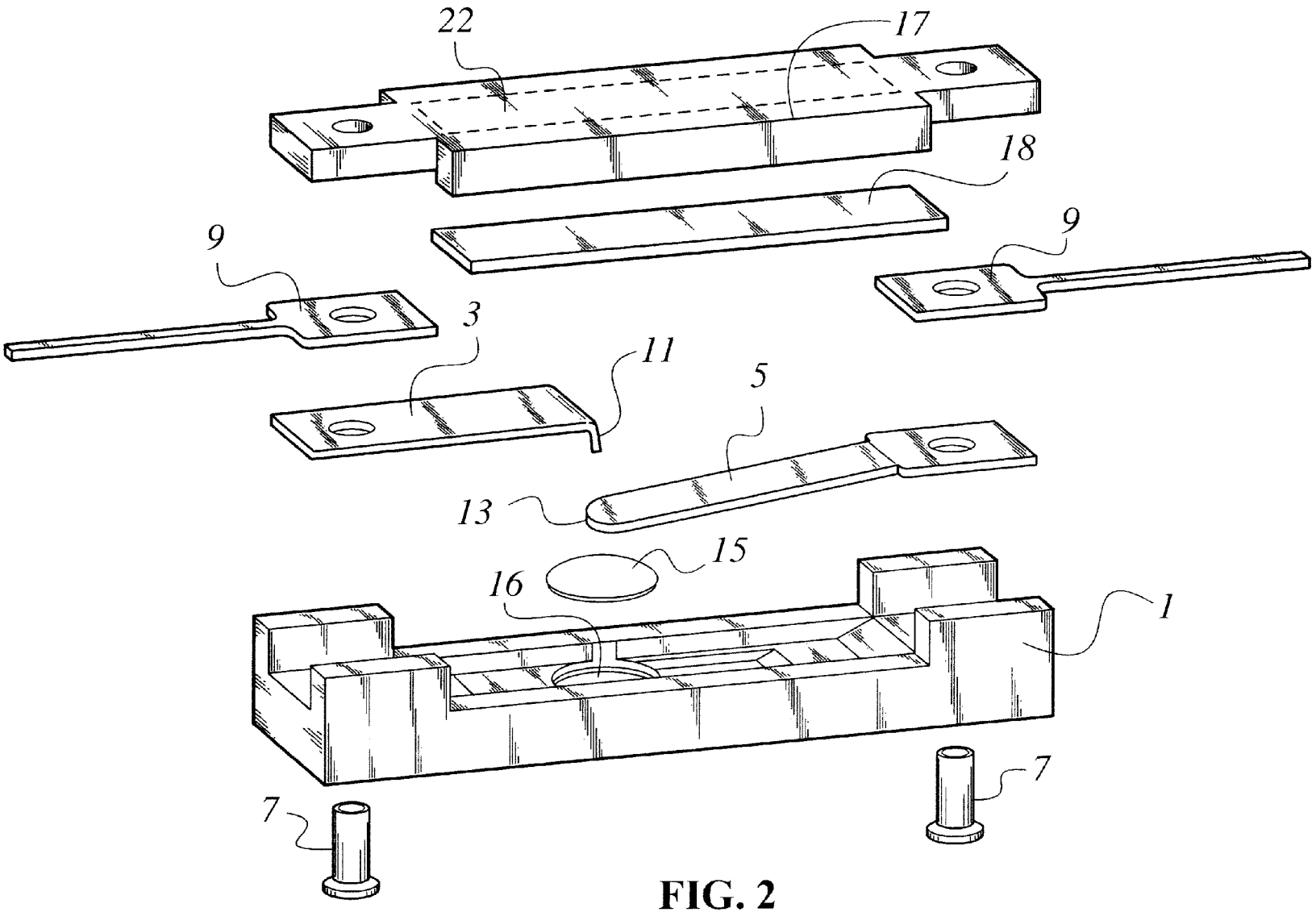
FIG. 2 is an exploded perspective side view of the bimetallic switch of FIG. 1, with portions thereof shown in phantom, further including a wafer or film as part of the assembly.

Referring to the drawings, as seen in FIGS. 1 and 2, an exemplary embodiment of a bimetallic switch according to the invention includes a housing or base 1 made of, for example, from an insulator material such as alumina or steatite, which houses therein a stationary first flexible contact member in the form of stationary cantilever arm 3, and a second flexible contact member in the form of movable cantilever arm 5. Arms 3 and 5 are both flexible, that is, they are both spring members, but have differing stiffnesses or coefficients of elasticity, and are made, for instance, of BeCu. They may be plated, i.e., with silver or a conventional silver alloy, for enhanced current carrying capability. The arms are further configured and positioned such that they are biased toward the housing or base 1 as shown. Arms 3 and 5 are secured to housing 1 by way of rivets 7, which additionally secure terminals 9 to arms 3 and 5. Rivets 7 are preferably made of steel. arms 3 and 5 and terminals 9 are also, as would be well recognized by a person skilled in the art, made of an electrically conductive material. Stationary cantilever arm 3 includes thereon a stationary contact portion 11, which, in the shown embodiment, is in the form of a flange, and which interacts with a movable counter-contact portion 13 of the movable cantilever arm 5. Movable cantilever arm 5 is supported in a cantilever manner adjacent stationary cantilever arm 3. A bimetallic element in the form of a bimetallic disc 15 is provided adjacent contact portion 13, and is positioned to be accommodated in or fit inside a housing recess 16 defined by housing 1. The bimetallic disc is made of a bimetal material dictated by temperature, and is preferably about 5 mm in diameter. A cover or lid plate 17 is provided for enclosing the movable cantilever arm, stationary cantilever arm and bimetallic disc within housing 1, the cover being secured to the housing via rivets 7 and preferably being fabricated from a non-conductive material such as alumina or steatite. Optionally, as seen in particular in FIG. 2, cover 17 may be provided with an opening 22 (shown in phantom), in combination with a thin wafer (i.e., film) 18 superposed therewith. The film 18 may be fabricated from a material such as a polyimide film sold under the trademark KAPTON® by E. I. DuPont (DuPont) of Delaware, or a polyester film sold under the Trademark MYLAR® by Dupont. The film 18 serves as an electrically insulative dust cover, which the skilled artisan will recognize tends to optimize the thermal response of the switch, due to the relatively efficient heat transfer through such a film to the bimetallic disk 15. The switch is preferably rated for 120/240 Volts AC, 15 Amps (at 120 Volts), 10 Amps (at 240 Volts), with a temperature range of 32 to 450 degrees Fahrenheit (depending on the bimetallic element selected).

Figure 3A:
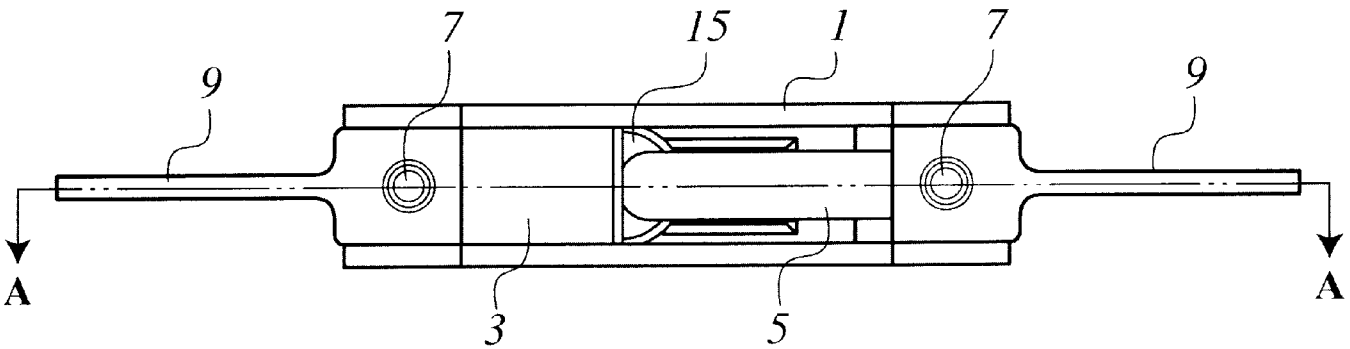
FIG. 3*a* is a top plan view of the switch of FIG. 1 with the switch cover removed, showing the switch in a closed position.
Figure 3B:
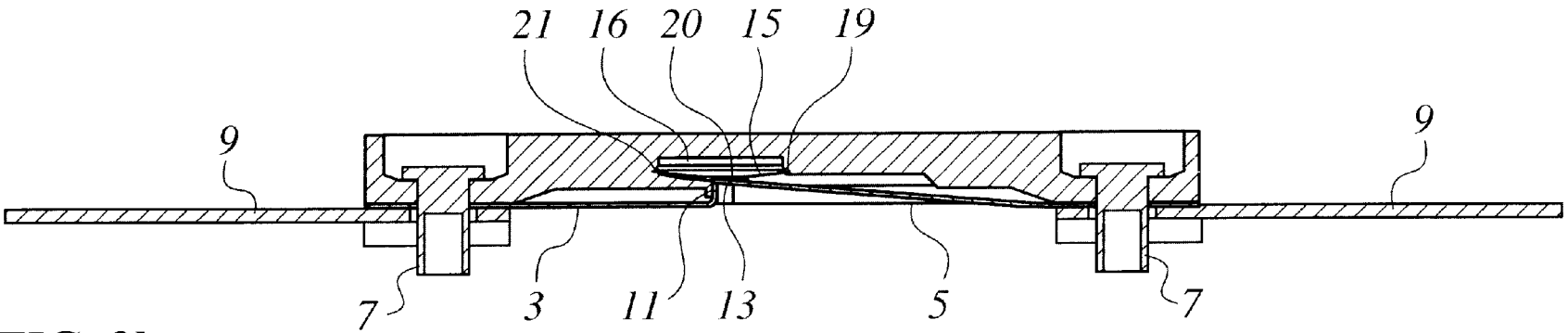
FIG. 3*b* is a cross-sectional view along section line A—A in FIG. 3*a*.

As seen in FIGS. 3*a* and 3*b,* the switch as seen in a closed position involves the contacting engagement of contact portions 11 and 13 with one another for establishing a current between terminals 9 as can be appreciated by one skilled in the art. When the switch is in its closed position, the bimetallic disc (received within housing recess 16) in a first mode thereof has a concave shape (i.e., when viewed from the base 1 side of the switch) its outer edge 19 being directed away from arms 3 and 5 against a seat 21 of recess 16 and its central dish-shaped portion 20 flexing inward (i.e., towards contact positions 11 and 13) to keep contact portion 13 in engagement with contact portion 11. The bimetallic disc, in this manner, with its central dish-shaped portion 20, biases the movable cantilever arm 5 onto stationary cantilever arm 3, thereby biasing contact portions 11 and 13 into engagement with one another.

As shown, seat 21 is preferably annular, having a diameter slightly less than that of disc 15, to supportably engage nominally the entire outer edge 19, when disc 15 is disposed in either of its modes (i.e., positions). Seat 21 is also preferably beveled as shown, to help center the disc 15 within recess 16 when disposed in the open position as discussed hereinbelow.

Figure 4A:
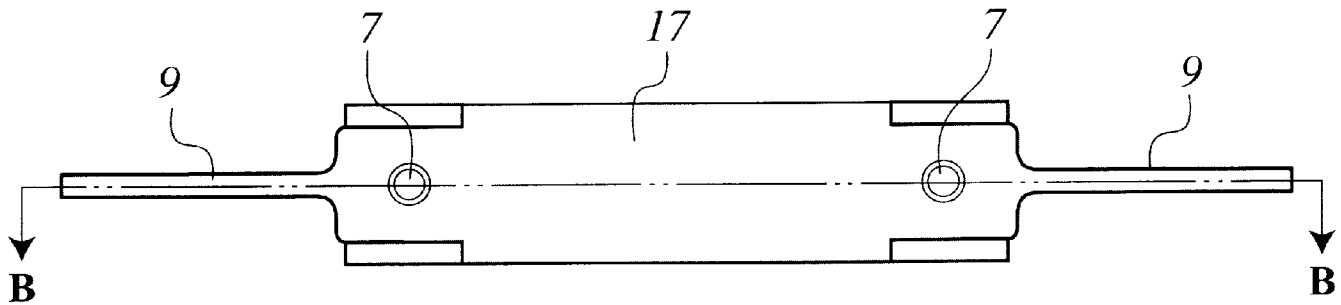
FIG. 4*a* is a view similar to FIG. 3*a,* showing the switch with the switch cover positioned thereon.
Figure 4B:
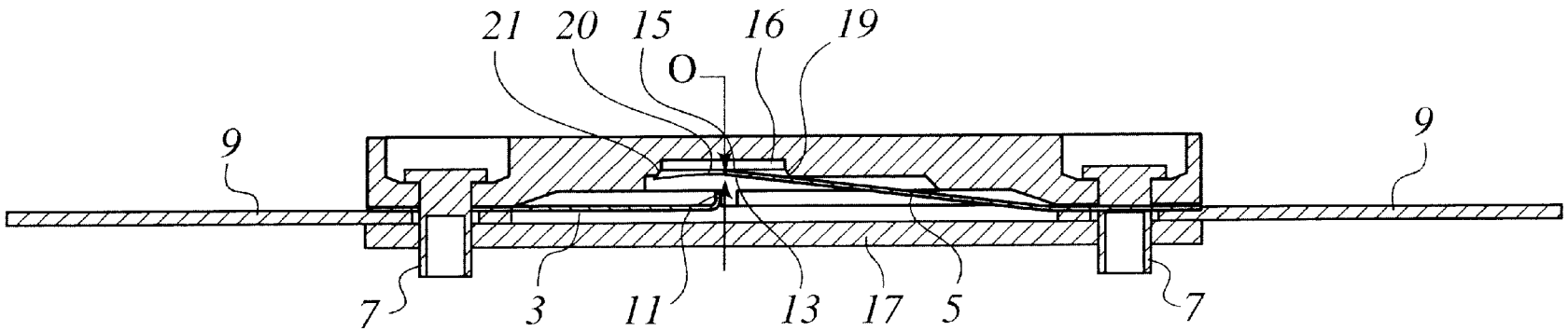
FIG. 4*b* is a cross-sectional view along section line B—B in FIG. 4*a*.

As further seen in FIGS. 4*a* and 4*b,* the switch as seen in an open position shows contact portions 11 and 13 as having been separated from one another for breaking the flow of current from one terminal 9 to the other. In an open position, the bimetallic disc has a convex shape (when viewed from the base 1 side of the switch), its outer edge 19 being directed toward arms 3 and 5 and its central dish-shaped portion 20 flexing toward recess 16, thus removing a biasing force of the disc onto the movable cantilever arm 5 and the stationary cantilever arm 3 and no longer urging contact portions 11 and 13 toward one another, thereby defining an open contact gap O therebetween. As can be been in FIG. 4*b,* when the bimetallic element has snapped into its second mode for opening the switch, both arms 3 and 5 have. moved in the direction of the bimetallic element, arm 5 having traveled further in that direction by virtue of its higher coefficient of elasticity with respect to that of arm 3. Thus, as can be recognized by one skilled in the art, the coefficient of elasticity corresponding to arm 3 is selected such that arm 3 travels along with the creeping motion of the bimetallic element, and stops at nominally the snapping point thereof, allowing arm 5 to travel further for breaking contact between contact portions 11 and 13.

It is to be noted that a rest mode of the switch, that, its normal or service state, may, according to the invention, either be closed, as seen in FIG. 3*b,* or be open, as seen in FIG. 4*b*. A main aspect of the invention involves compensation for creep during an opening of the switch using different stiffnesses for flexible contact members having the switch contacts thereon, regardless of whether the rest mode of the switch is open or closed. Additionally, while the above example depicted in the appended drawings relates to an automatic reset switch, the invention is meant to include within its ambit switch constructions which involve other types of bimetallic switches, such as manual resets and one shots as described above. For example, in a manual rest switch employing the principle of the invention, the switch may be configured to be closed after an opening thereof by employing a plunger-type mechanism such as a push-button (not shown) to the device, this mechanism allowing the disc to be pushed back into its closed position. In addition, in the instant disclosure, the words "bimetallic" and "bimetal" encompass constructions where the snap action element is made of two or more types of metal for being thermally responsive to effect the desired switch over. Thus, trimetallic switches, for example, are also included within the scope of the invention.

In operation, the switch alternates between a closed position, as seen in FIG. 3*b,* and an open position, as seen in FIG. 4*b*. In an automatic reset switch, the bimetallic disc would snap from its first mode to its second mode at a high temperature or "hot snap" temperature to open the switch, and snap back from its second mode into its first mode at a low temperature or "cold snap" temperature to close the switch. As an example, these two temperatures can be, for example, 200 degrees Fahrenheit and 145 degrees Fahrenheit, respectively. Assuming that the switch in the shown figures is configured in the above-described manner, when the temperature rises to close to 200 degrees Fahrenheit, the deformation of the bimetallic disc progresses gradually until the amount of deformation has reached the threshold value. At that time, the deformation progresses quickly. The step at which the deformation progresses gradually during the initial stage is called creep. The process at which the deformation progresses rapidly is called snap action. The gradual deformation of the disc, that is, creep, could cause the electrical contact portions to open slightly, potentially causing arcing, and thus significantly affecting the life of the contact portions. However, arms 3 and 5 have differing stiffnesses, chosen so as to allow the slow deformation to take place while still permitting the contact portions to remain in engagement. Thus, when the bimetallic disc 15 exhibits creep by deforming prior to a snapping thereof from its first mode into its second mode, cantilever arm 3 and cantilever arm 5 flex in a deformation direction of the bimetallic element such that the first contact portion 11 and the second contact portion 13 remain engaged until the snapping of the bimetallic disc 15 from its first mode into its second mode. The above is effected by selecting the coefficient of elasticity of the stationary antilever arm 3 to be much lower than that of the movable cantilever arm 5. Thus, stationary cantilever arm 3 moves only slightly (see FIG. 4*b*) before it stops moving altogether. By making this stationary cantilever arm deflection larger than or equal to the creep zone of the disc, it is possible to achieve a substantially creepless bimetallic switch. The ratio of spring constants for the arms will depend on the type of bimetallic disc used in the construction.

After the threshold temperature of 200 degrees Fahrenheit has been reached, the disc then snaps and breaks the current between contact portions 11 and 13, thereby opening the switch (and placing the bimetallic disc in its convex mode) as shown in FIG. 4*b*.

Conversely, for establishing a contact closure, the temperature must drop to below 145 degrees Fahrenheit. When the temperature is close to the cold snap temperature, disc 15 begins to slowly deform, that is, to exhibit creep. Any effects of such creep are removed or compensated by maintaining a minimum open contact gap O (see FIG. 4*b*) between contact portions 11 and 13 in their open position so that any movement of the contact portions towards one another due to creep is harmless, i.e., fails to move the contact portions close enough to generate any arcing. The dimension of gap O is preselected in conformity with a curvature of disc 15, and is further a function of, primarily, the readily observable creeping characteristics of the disc being used between the selected threshold temperatures and at the selected voltage and amperage rating of the contact portions 11 and 13.

As can be appreciated from the above construction, and, especially, from the provision of flexible arms 3 and 5, the construction of the switch according to the invention allows the use of bimetallic switches of a simple and cost effective construction where the effects of creep are neutralized, thereby providing a switch of simplified construction which has a longer contact life. Additionally, the provision of gap O adds to the above advantage by removing the effects of creep during contact closure, thus providing predictability of switch behavior in the vicinity of the cold snap temperature, and further enabling the device to handle higher electrical loads. The construction of a bimetallic switch with two flexible members of differing stiffnesses further allows the use of a disc which is smaller relative to those of the prior art, such as, for example, a disc with a diameter of about 5 mm, thereby allowing fabrication of a switch having a very compact footprint, such as, for example, ¼" by 1".

The invention also includes within its scope the elimination of the cover, to improve the thermal response time for the switch and reduce cost.

Furthermore, the switch according to the invention can be designed to fit its application requirements. Thus, it can be made oval, round or may be enclosed in a glass sealed assembly or metallic housing.

Advantageously, as discussed hereinabove, the provision of a wafer or film 18 in combination with opening 22 serves to optimize the thermal response of the switch, due to the relatively efficient transfer through the film to the bimetallic disk 15 (i.e., due to the relative thinness of the film).

Figure 5:
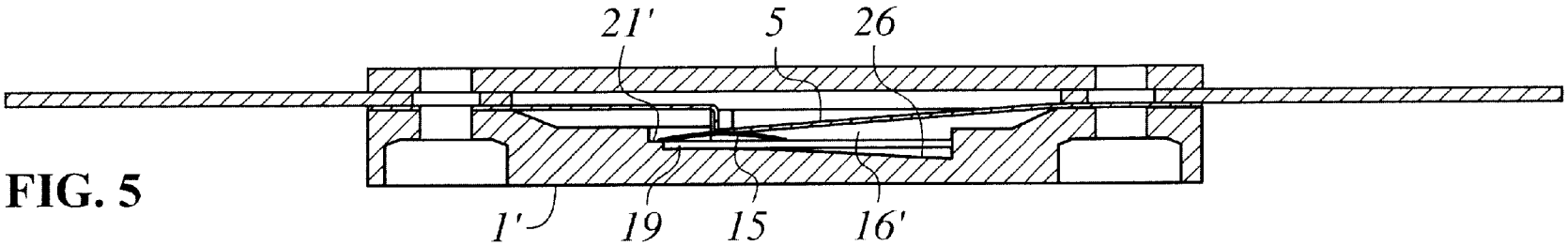
FIG. 5 is a view similar to FIG. 4*b,* in an inverted orientation, of an alternate embodiment of a switch of the present invention in a closed position.
Figure 6:
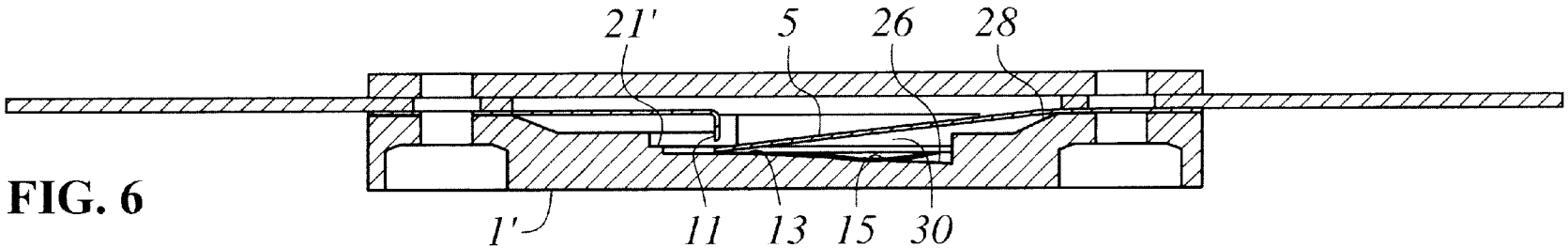
FIG. 6 is a view similar to FIG. 5, of the alternate embodiment of FIG. 5 with the switch in an open position.
Figure 7:
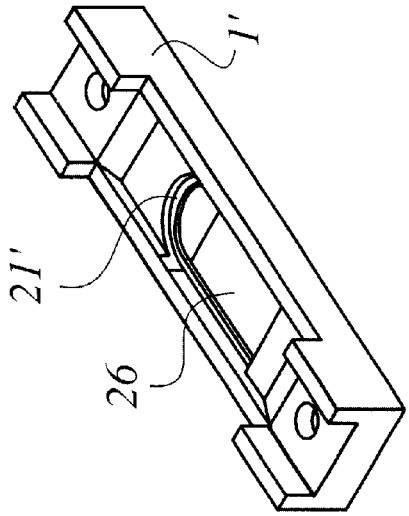
FIG. 7 is a perspective view of a portion of the switch of FIGS. 5 and 6.

Attention is now directed to an alternate embodiment of the present invention as shown in FIGS. 5–7. This embodiment is substantially similar to that of FIGS. 1–4*b* described hereinabove, while being modified to function as a latching switch. As shown, body 1' is provided with a modified recess 16' having a peripheral seat 21' and a floor portion (i.e., cam surface) 26. Unlike seat 21 described hereinabove, which forms a full 360 degree annulus, seat 21' of this embodiment extends semi-circularly (i.e., about 180 degrees) with opposite ends thereof extending generally parallel to one another along the edge, and/or fairing into, floor portion 26. Floor portion 26 is disposed in spaced, superposed relation to movable cantilever arm 5, preferably diverging from arm 5 as it extends from the contact 13 end (i.e., distal end) of the arm 5, towards proximal pivot end 28 thereof. The divergent floor portion 26 and arm 5 define a recess 16' having a proximal end 30 sized and shaped to retain the disc 15 therein with sufficient clearance so that any subsequent snapping of the disc 15 no longer affects the position of the arm 5 once the disc 15 is disposed therein as shown in FIG. 6. The floor portion 26 is further sized and shaped so that once the disc 15 snaps from its closed position as shown in FIG. 5 (i.e., once the disc snaps so that its center extends away from the contact 13 relative to edge 19 thereof), the biasing arm 5 cams the disc 15 along the floor portion 26 towards proximal end 28 of arm 5 into proximal end 30 of recess 16', as will be discussed in greater detail hereinbelow. Operationally, when disposed as shown in FIG. 5, the edge 19 of the disc 15 is engaged with seat 21', with its central portion extending towards contact 13 to maintain the contacts 11 and 13 in their closed positions substantially as shown and described hereinabove with respect to the embodiment of FIGS. 1–4*b*. Once the temperature becomes sufficient to snap the center of the disc 15 into the recess 16', the biasing force of the movable arm 5 cams the disc 15 away from the contact 13 and generally along floor portion 26 towards proximal end 30 of recess 16' as shown in FIG. 6. Once this position has been reached, further snapping of the disc 15 (i.e., due to cycling temperature) will not serve to re-open contacts 11 and 13. Thus, advantageously, the embodiment of FIGS. 5–7 serves as a latching switch that will not re-close the contacts once they have been initially opened.

Operationally, when disposed as shown in FIG. 5, the edge 19 of the disc 5 is engaged with seat 21', with its central portion extending towards contact 13 to maintain the contacts 11 and 13 in their closed positions substantially as shown and described hereinabove with respect to the embodiment of FIGS. 1–4*b*. Once the temperature becomes sufficient to snap the center of the disc 15 into the recess 16', the biasing force of the movable arm 5 cams the disc 5 away from the contact 13 and generally along floor portion 26 towards proximal end 30 of recess 16' as shown in FIG. 6. Once this position has been reached, further snapping of the disc 5 (i.e., due to cycling temperature) will. not serve to re-close contacts 11 and 13. Thus, advantageously, the embodiment of FIGS. 5–7 serves as a latching switch that will not re-close the contacts once they have been initially opened.

The skilled artisan will recognize that the floor portion 26 may be provided with any configuration, i.e., any degree of divergence (or slope), relative to the arm 5, sufficient to render further snapping of the disc 15 incapable of re-closing the contacts 11 and 13 once the contacts have been initially opened, without departing from the spirit and scope of the present invention.

Moreover, although the invention has been shown and described herein with respect to a bimetallic disc, the skilled artisan should recognize that a bimetallic element of substantially any geometric configuration, including rectilinear bimetallic strips, or bimetallic elements of any other convenient construction, may be used without departing from the spirit and scope of the present invention. The present invention may also be used with any number of bimetallic elements, i.e., stacked or otherwise linked to one another, without departing the spirit and scope of the invention.

It will be apparent to those skilled in the art that the disclosed invention may be modified in numerous ways and may assume many embodiments other than the preferred forms specifically set out and described above. Accordingly, it is intended by the appended claims to cover all modifications of the invention which fall within the true spirit and scope of the invention.

What is claimed is:

1. A bimetallic switch comprising:

a bimetallic element being adapted to snap between a first mode and a second mode, the first mode corresponding to a closed position of the switch, and the second mode corresponding to an open position of the switch;

a first flexible contact member interposed between the bimetallic element and a second flexible contact member;

the first flexible contact member having a first contact portion thereon;

the second flexible contact member having a second contact portion thereon;

the first contact portion and the second contact portion being disposed relative to one another such that, when the switch is in a closed position, the first contact portion and the second contact portion are biased against one another by the bimetallic element to be in engagement with one another, and when the switch is in an open position the first contact portion and the second contact portion define an open contact gap therebetween;

a first terminal electrically conductively coupled to the first flexible contact member;

a second terminal electrically conductively coupled to the second contact portion such that when the switch is closed, electrical continuity exists between the first terminal and the second terminal wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode.

2. The bimetallic switch according to claim 1, wherein the first contact portion is positioned with respect to the second contact portion for maintaining a minimum open contact gap therebetween wherein creep is isolated during contact closure.

3. The bimetallic switch according to claim 1, wherein:

the first flexible contact member comprises a first cantilever arm; and the second flexible contact member comprises a second cantilever arm, the first contact portion and the second contact portion being disposed on respective free ends of the first cantilever arm and the second cantilever arm.

4. The bimetallic switch of claim 3, wherein said first and second flexible contact members are both resiliently flexed against their bias when said contacts are in engagement with one another.

5. The bimetallic switch according to claim 3, wherein the second contact portion comprises a flange extending toward the first contact portion.

6. The bimetallic switch of claim 1, said bimetallic element being alternately snappable between said first and second modes in response to ambient temperature, to alternately disengage and engage said first and second contact portions.

7. The bimetallic switch according to claim 1, further comprising a housing having inner walls defining at least a partial enclosure therein, wherein the bimetallic element, the first flexible contact member and the second flexible contact member are disposed within the partial enclosure.

8. The bimetallic switch according to claim 7, wherein the housing is one of parallelepiped-shaped, round and oval.

9. The bimetallic switch according to claim 7, further comprising a cover disposed over the partial enclosure to close the same for defining an enclosure about the bimetallic element, the first flexible contact member and the second flexible contact member.

10. A bimetallic switch comprising:

a bimetallic element being adapted to snap between a first mode and a second mode, the first mode corresponding to a closed position of the switch, and the second mode corresponding to an open position of the switch;

a first flexible contact member disposed adjacent the bimetallic element and having a first contact portion thereon;

a first terminal electrically conductively coupled to the first flexible contact member;

a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween;

a second terminal electrically conductively coupled to the second contact portion such that when the switch is closed, electrical continuity exists between the first terminal and the second terminal;

a cam surface engagable with the bimetallic element when the bimetallic element is disposed in the second mode, at least one of the flexible contact members biasing the bimetallic element against the cam surface to cam the bimetallic element clear of the flexible contact member when the bimetallic element is in the second mode, wherein the bimetallic switch is latched open;

wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode.

11. A bimetallic switch comprising:

a bimetallic element being adapted to snap between a first mode and a second mode, the first mode corresponding to a closed position of the switch, and the second mode corresponding to an open position of the switch;

a first flexible contact member disposed adjacent the bimetallic element and having a first contact portion thereon;

a first terminal electrically conductively coupled to the first flexible contact member;

a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween;

a second terminal electrically conductively coupled to the second contact portion such that when the switch is closed, electrical continuity exists between the first terminal and the second terminal;

a housing having inner walls defining at least a partial enclosure therein, wherein the bimetallic element, the first flexible contact member and the second flexible contact member are disposed within the partial enclosure;

wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode; and wherein the inner walls of the housing further define a recess therein as part of the partial enclosure, the bimetallic element being accommodated in the recess.

12. The bimetallic switch according to claim 1, wherein the bimetallic element is a bimetallic disc.

13. The bimetallic switch of claim 12, wherein said recess further comprises a seat alternately engageable and disengageable with said disc when said disc is respectively disposed in said first and second modes.

14. The bimetallic switch of claim 13, said recess further comprising a cam surface engageable with said bimetallic element when said bimetallic element is disposed in said second mode, at least one of said flexible contact members biasing said bimetallic element against said cam surface to cam said bimetallic element clear of said flexible contact member when said bimetallic element is in said second mode, wherein said bimetallic switch is latched open.

15. The bimetallic switch according to claim 11, wherein:

the bimetallic element is a bimetallic disc, and the recess is cylindrical and has a seat accommodating an outer edge of the disc therein.

16. The bimetallic switch of claim 15, wherein said seat engages said bimetallic element when said disc is disposed in both said first mode and said second mode.

17. A bimetallic switch comprising:

a bimetallic element being adapted to snap between a first mode and a second mode, the first mode corresponding to a closed position of the switch, and the second mode corresponding to an open position of the switch;

a first flexible contact member disposed adjacent the bimetallic element and having a first contact portion thereon;

a first terminal electrically conductively coupled to the first flexible contact member;

a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween;

a second terminal electrically conductively coupled to the second contact portion such that when the switch is closed, electrical continuity exists between the first terminal and the second terminal;

a housing having inner walls defining at least a partial enclosure therein, wherein the bimetallic element, the first flexible contact member and the second flexible contact member are disposed within the partial enclosure;

a cover disposed over the partial enclosure to close the same for defining an enclosure about the bimetallic element, the first flexible contact member and the second flexible contact member;

wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode; and wherein the cover includes an opening superposed with a film disposed between the cover and the partial enclosure for enhancing thermal response of the switch.

18. The bimetallic switch of claim 17 wherein the film is electrically insulative.

19. The bimetallic switch of claim 17 wherein the film is fabricated from a material selected from the group consisting of polyester and polyimide.

20. A latching bimetallic switch comprising:

a bimetallic element alternately snappable between a first mode and a second mode, the first mode corresponding to a closed position of the switch, and the second mode corresponding to an open position of the switch;

a first flexible contact member disposed adjacent the bimetallic element and having a first contact portion thereon;

a first terminal electrically conductively coupled to the first flexible contact member;

a second flexible contact member disposed adjacent the first flexible contact member and having a second contact portion thereon, the first contact portion and the second contact portion being disposed relative to one another such that, when the switch is in a closed position, the first contact portion and the second contact portion are each disposed against their bias and in mutual engagement, by the bimetallic element, and when the switch is in an open position, the first contact portion and the second contact portion define an open contact gap therebetween;

a second terminal electrically conductively coupled to the second contact portion such that when the switch is closed, electrical continuity exists between the first terminal and the second terminal;

the bimetallic element, first flexible contact member, and the second flexible contact member being disposed within a partial enclosure having a recess sized and shaped to receive the bimetallic element therein, the recess having a seat alternately engagable and disengageable with said disc when said disc is respectively disposed in said first and second modes;

the recess also having a cam surface engagable with said bimetallic element when said bimetallic element is disposed in said second mode;

wherein when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode, at least one of said flexible contact members biasing said bimetallic element against said cam surface to cam said bimetallic element clear of said flexible contact member when said bimetallic element is in said second mode, wherein said bimetallic switch is latched open.

21. A method for fabricating a bimetallic switch, the method comprising the steps of:

providing a bimetallic element being adapted to snap between a first mode and a second mode, the first mode corresponding to a closed position of the switch, and the second mode corresponding to an open position of the switch;

disposing a first flexible contact member adjacent the bimetallic element, the first flexible contact member having a first contact portion thereon;

electrically conductively coupling a first terminal to the first flexible contact member;

disposing a second flexible contact member adjacent the first flexible contact member, the second flexible contact member having a second contact portion thereon, the first contact portion and the second contact portion being disposed relative to one another such that, when the switch is in a closed position, the first contact portion and the second contact portion are biased against one another by the bimetallic element to be in engagement with one another, and when the switch is in an open position, the first contact portion and the second contact portion define an open contact gap therebetween;

electrically conductively coupling a second terminal to the second contact portion such that when the switch is closed, electrical continuity exists between the first terminal and the second terminal;

wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode; and wherein the first flexible contact member is interposed between the bimetallic element and the second flexible contact member.

22. The method of claim 21, comprising the step of providing a cam surface engagable with said bimetallic element when said bimetallic element is disposed in said second mode, at least one of said flexible contact members biasing said bimetallic element against said cam surface to cam said bimetallic element clear of said flexible contact member when said bimetallic element is in said second mode, wherein said bimetallic switch is latched open.

23. A bimetallic switch comprising:

a bimetallic element being adapted to snap between a first mode and a second mode, the first mode corresponding to a closed position of the switch, and the second mode corresponding to an open position of the switch;

a first flexible contact member disposed adjacent the bimetallic element and having a first contact portion thereon;

a first terminal electrically conductively coupled to the first flexible contact member;

a second flexible contact member disposed adjacent the first flexible contact member and having a second contact portion thereon, the first contact portion and the second contact portion being disposed relative to one another such that, when the switch is in a closed position, the first contact portion and the second contact portion are biased against one another by the bimetallic element to be in engagement with one another and when the switch is in an open position, the first contact portion and the second contact portion define an open contact gap therebetween;

a second terminal electrically conductively coupled to the second contact portion such that when the switch is closed, electrical continuity exists between the first terminal and the second terminal wherein, when the bimetallic element exhibits creep by deforming prior to a snapping thereof from its first mode into its second mode, the first flexible contact member and the second flexible contact member flex in a deformation direction of the bimetallic element such that the first contact portion and the second contact portion remain engaged until the snapping of the bimetallic element from its first mode into its second mode;

wherein the first contact member has a coefficient of elasticity greater than that of the second flexible contact member; and wherein when the bimetallic element exhibits creep by deforming prior to snapping thereof from the first mode to the second mode, the second flexible contact member flexes along with the creeping motion thereof and stops at nominally the snapping point thereof thereby allowing the first flexible contact member to flex further for breaking contact.

* * * * *